US005872430A

United States Patent [19]

Konopka

[11] Patent Number: 5,872,430

[45] Date of Patent: Feb. 16, 1999

[54] SINGLE SWITCH ELECTRONIC BALLAST WITH LOW IN-RUSH CURRENT

[75] Inventor: John G. Konopka, Barrington, Ill.

[73] Assignee: Motorola Inc., Schaumburg, Ill.

[21] Appl. No.: 696,714

[22] Filed: Aug. 14, 1996

[51] Int. Cl.[6] ..... H05B 37/02

[52] U.S. Cl. ..... 315/219; 315/244; 315/247; 315/DIG. 7

[58] Field of Search ..... 315/244, 219, 315/247, 205, 307, DIG. 5, DIG. 7

[56] References Cited

U.S. PATENT DOCUMENTS

| | | | |
|---|---|---|---|
| 4,075,476 | 2/1978 | Pitel . | |
| 4,109,307 | 8/1978 | Knoll . | |
| 4,277,728 | 7/1981 | Stevens . | |
| 4,376,912 | 3/1983 | Jernakoff . | |
| 4,500,812 | 2/1985 | Roche . | |
| 4,555,753 | 11/1985 | Takahashi . | |
| 5,012,161 | 4/1991 | Borowiec et al. . | |
| 5,057,749 | 10/1991 | Nilssen . | |
| 5,115,347 | 5/1992 | Nilssen . | |
| 5,229,690 | 7/1993 | Ohnishi et al. . | |
| 5,258,692 | 11/1993 | Jones | 315/247 |
| 5,399,944 | 3/1995 | Konopka et al. | 315/219 |
| 5,453,665 | 9/1995 | Konopka . | |

*Primary Examiner*—Michael Shingleton
*Attorney, Agent, or Firm*—Kenneth D. Labudda; Gary J. Cunningham

[57] ABSTRACT

An electronic ballast (200) includes a rectifier circuit (20), a clamp inductor (44), an electronic switch (62), a control circuit (60) for driving the electronic switch (62), an energy storage capacitor (34), a first diode (38), a second diode (50), a clamping capacitor (58), and an output circuit (80). In a preferred embodiment, the rectifier circuit (20) includes a full-wave diode bridge (22) and a high frequency filter capacitor (24), and the output circuit (80) has a resonant inductor (82), a resonant capacitor (92), and a DC blocking capacitor (98). The ballast (200) provides power factor correction, low in-rush current, and high frequency power for fluorescent lamps, but requires only a single electronic switch (62) and a single clamp inductor (44).

20 Claims, 5 Drawing Sheets

FLUORESCENT LAMPS
OUTPUT CIRCUIT
CONTROL CIRCUIT
RECTIFIER CIRCUIT
140
130
136
80
64
66
62
58
56
52
54
50
48
46
44
200
60
42
40
38
36
34
30
32
20
12
14
10

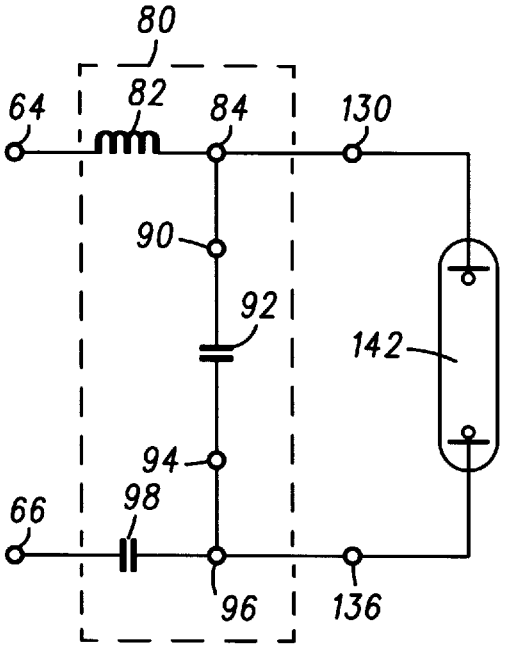
FIG. 3
FIG. 4
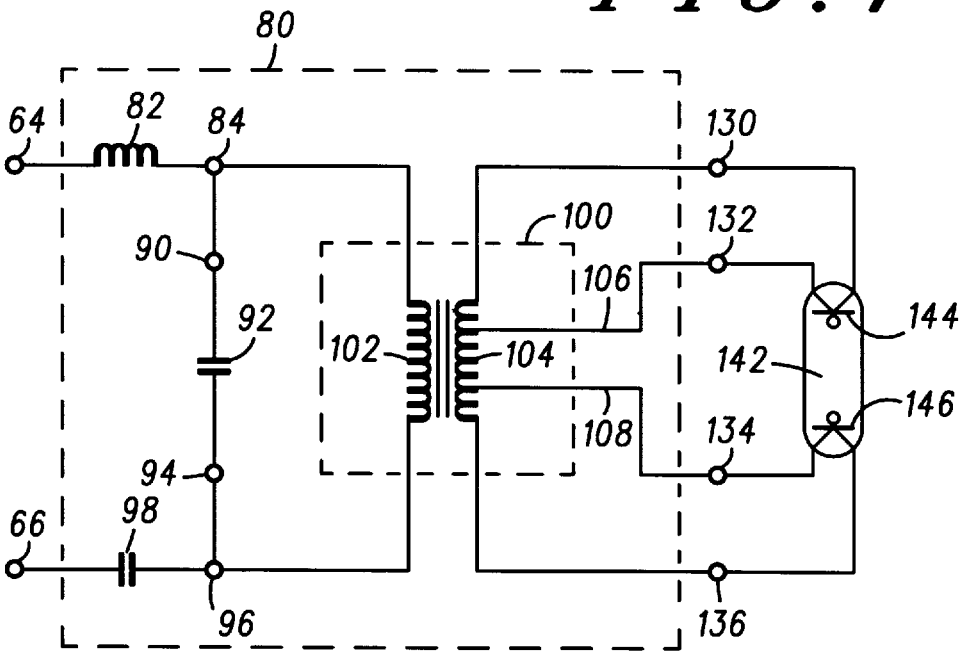

SINGLE SWITCH ELECTRONIC BALLAST WITH LOW IN-RUSH CURRENT

FIELD OF THE INVENTION

The present invention relates to the general subject of electronic ballasts for fluorescent lamps and, in particular, to a single switch electronic ballast with low in-rush current.

BACKGROUND OF THE INVENTION

Traditional magnetic coil ballasts possess a number of operational disadvantages, such as poor energy efficiency and high visible flicker. Electronic ballasts overcome many of the shortcomings of magnetic ballasts, but at a considerably higher monetary cost.

A common type of electronic ballast includes a rectifier circuit, a switching converter for providing power factor correction, a high frequency inverter, and an output circuit. Such a ballast provides a high frequency current for driving the lamps with minimal visible flicker and is far superior to magnetic ballasts with regard to energy efficiency and power factor correction. On the other hand, such a ballast typically requires three or more power transistor switches, in addition to a large number of other components, of which electrolytic capacitors and magnetic components such as inductors and transformers are typically the most costly and the most difficult to manufacture. Due to its complexity and high component count, the resulting ballast is not economically competitive with relatively low cost magnetic ballasts.

In addition to the drawback of cost, several types of electronic ballasts also possess the important disadvantage of significant in-rush current. In-rush current, which is an inherent characteristic of many electronic circuits which have a large bulk capacitance, is a transient pulse of current that is generated when power is first applied to the circuit. The amplitude of the in-rush current pulse is maximized when power is first applied to the circuit at the peak of the AC line voltage cycle. The peak value of the high current pulse drawn by the circuit from the AC line source in such a case is customarily referred to as the peak in-rush current.

Excessive in-rush current is highly undesirable, having been associated with nuisance tripping of circuit breakers as well as degradation and welding of switch contacts on AC line-side equipment such as relays and occupancy sensors. An additional disadvantage of high in-rush current is the resulting design requirement of high surge current ratings for those circuit components through which the in-rush pulse flows.

Further, many electronic ballasts include one or more energy storage capacitors, and contain a switching converter in which the voltage across the energy storage capacitor(s) appreciably exceeds the peak value of the AC line voltage. Due to several operational and performance requirements, the energy storage capacitors must have a relatively large capacitance value which, when combined with the need for a relatively high voltage rating, dictates the use of electrolytic capacitors. Since the monetary cost and physical size of an electrolytic capacitor increases with the arithmetic product of its capacitance and its voltage rating, a substantial reduction in the material cost and physical size of the ballast can be realized by developing a ballast having a converter stage with a significantly lower voltage across the energy storage capacitor(s).

Thus, a need exists for an electronic ballast circuit that rivals the low monetary cost and low in-rush current of magnetic ballasts, but that retains at least some of the key advantages, such as high energy efficiency and negligible visible flicker, of more costly electronic ballasts. Since magnetic components, power transistor switches, and electrolytic capacitors are among the largest and most expensive parts used in electronic ballasts, and thus detract greatly from the goals of low material and manufacturing cost, significant impetus exists for developing new ballasts in which the number, complexity, and cost of such components is reduced or minimized.

It is therefore apparent that an electronic ballast which provides energy efficient, low flicker, high frequency powering of fluorescent lamps, which has low in-rush current, and which requires fewer and less costly components than existing electronic ballasts, would constitute a considerable improvement over the prior art.

BRIEF DESCRIPTION OF THE DRAWINGS

FIGS. 3 and 4 are circuit diagrams of alternative output circuits, in accordance with the present invention.

DETAILED DESCRIPTION OF A PREFERRED EMBODIMENT

Figure 1:
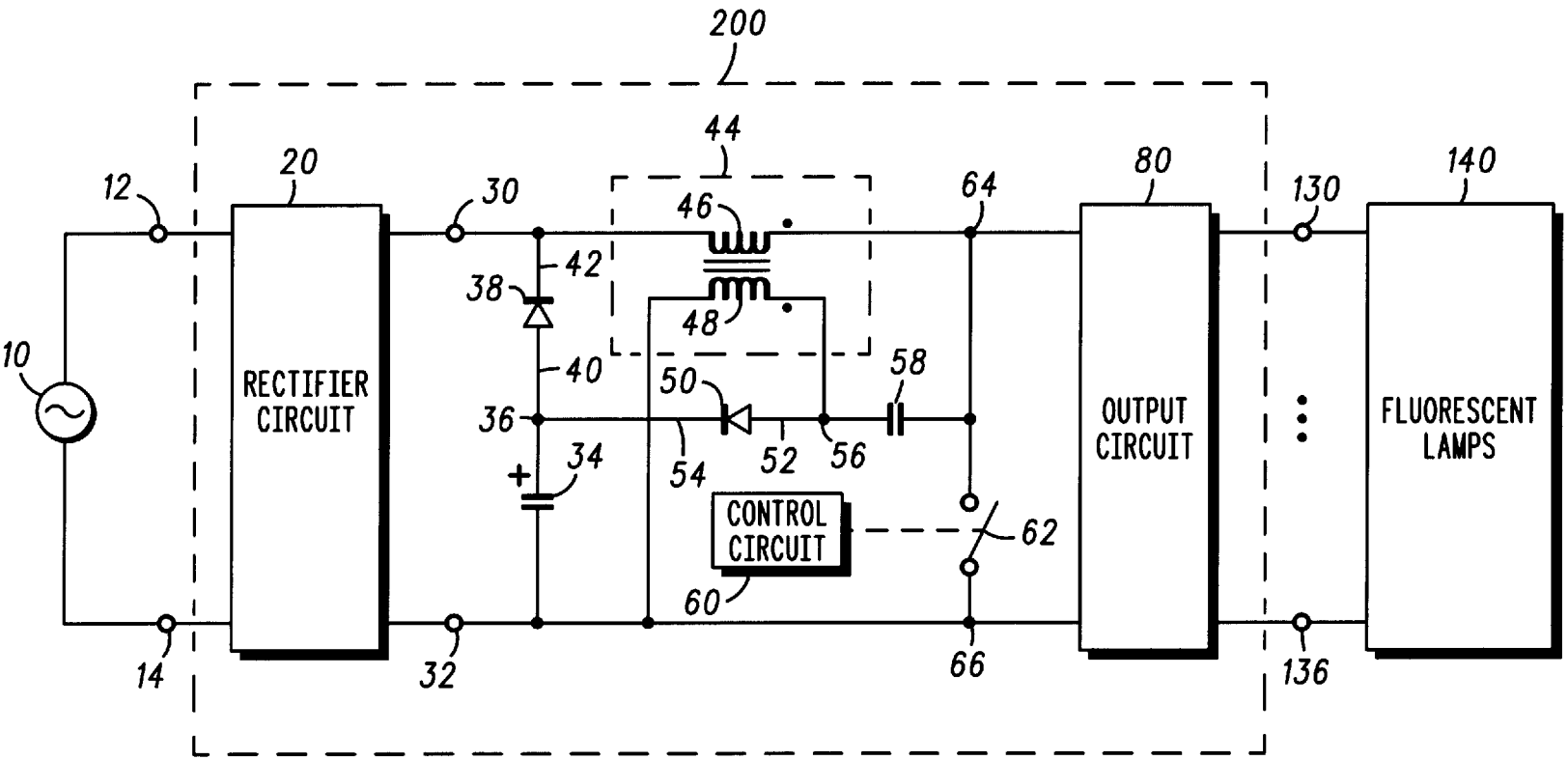
FIG. 1 is an electrical schematic of a low in-rush current electronic ballast having a single electronic switch, in accordance with the present invention.

FIG. 1 shows an electronic ballast 200 for driving a fluorescent lamp load 140 that includes one or more fluorescent lamps. The ballast 200 includes a rectifier circuit 20, a clamp inductor 44, an electronic switch 62, a control circuit 60 for driving the electronic switch 62, a clamping capacitor 58, a first diode 38, a second diode 50, an energy storage capacitor 34, and an output circuit 80.

The rectifier circuit 20 has a pair of input terminals 12, 14 for receiving an alternating current (AC) source 10, and a pair of output terminals 30, 32. The clamp inductor 44 includes a primary winding 46 that is coupled between a first output terminal 30 of rectifier circuit 20 and a first node 64, and a secondary winding 48 that is coupled between a second node 56 and a circuit ground node 66. The circuit ground node 66 is coupled to a second output terminal 32 of rectifier circuit 20. The electronic switch 62 is coupled between the first node 64 and the circuit ground node 66. Energy storage capacitor 34 is coupled between a third node 36 and the circuit ground node 66. The first diode 38 has an anode 40 that is coupled to the third node 36, and a cathode 42 that is coupled to the first output terminal 30 of rectifier circuit 20. The second diode 50 has an anode 52 that is coupled to the second node 56, and a cathode 54 that is coupled to the third node 36. Clamping capacitor 58 is coupled between the first node 64 and the second node 56. Finally, the output circuit 80 is coupled between the first node 64 and the circuit ground node 66, and includes at least two output wires 130, 136 that are adapted for connection to a fluorescent lamp load 140 having one or more fluorescent lamps.

Electronic ballast 200 supplies a high frequency alternating current for efficiently powering fluorescent lamp load 140 and provides for power factor correction and low in-rush current, but requires only a single electronic switch. Ballast 200 thus offers considerable advantages with regard to component count, physical size, and costs of material and manufacturing.

In a practical implementation of ballast 200, power switch 62 consists of any of a number of controllable devices which are suited for high power switching, examples of which are a field-effect transistor (FET) and a bipolar junction transistor (BJT). The actual choice of which type of device to use for electronic switch 62 is dictated by a number of design considerations, such as the voltage and current experienced by the electronic switch 62, characteristics of the drive signal provided by control circuit 60, as well as the material costs of the devices themselves.

Figure 2:
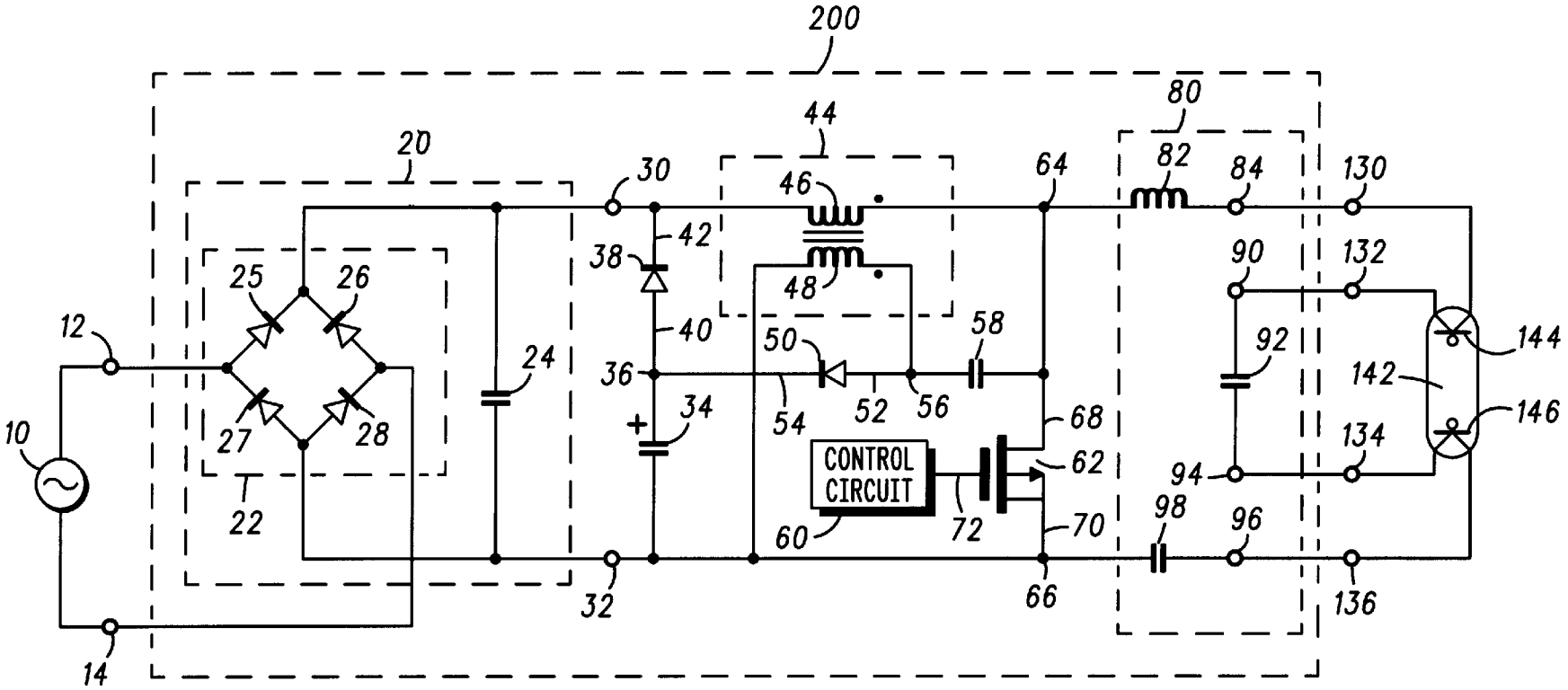
FIG. 2 is an electrical schematic of a preferred embodiment of the electronic ballast circuit of FIG. 1, in accordance with the present invention.

A preferred embodiment of ballast 200 is described in FIG. 2. The rectifier circuit 20 includes a full-wave diode bridge 22 and a high frequency filter capacitor 24 that is coupled across the output terminals 30, 32 of rectifier circuit 20. The function of high frequency filter capacitor 24 is to supply a demand for high frequency current which arises from operation of electronic switch 62 at a high frequency rate that is preferably in excess of 20,000 Hertz. In the absence of capacitor 24, the high frequency current would have to be supplied directly from the AC source 10, the undesirable results of which would include degradation of power factor and higher total harmonic distortion in the current supplied by AC source 10. In a preferred embodiment, electronic switch 62 comprises a field-effect transistor having a drain terminal 68, a source terminal 70, and a gate terminal 72. The drain terminal 68 is coupled to the first node 64, the source terminal is coupled to the circuit ground node 66, and the gate terminal is adapted to receive a drive signal supplied by control circuit 60. Control circuit 60 may include a pulse-width modulator or other type of driver arrangement for driving the electronic switch 62 at a high frequency rate so as to provide power factor correction and supply high frequency power to at least one fluorescent lamp 142 by way of output circuit 80.

Referring again to FIG. 2, the primary winding 46 and secondary winding 48 of clamp inductor 44 are oriented in relation to each other such that the presence of a positive voltage across the secondary winding 48 from the second node 56 to the circuit ground node 66 coincides with the presence of a positive voltage across the primary winding 46 from the first node 64 to the first output terminal 30 of rectifier circuit 20. Furthermore, in order to simplify the design of ballast 200 and reduce power losses in clamp inductor 44, it is preferred that primary winding 46 and secondary winding 48 have an approximately equal number of wire turns (i.e., a 1:1 turns ratio).

In the embodiment shown in FIG. 2, output circuit 80 comprises a series resonant circuit that includes a resonant inductor 82 and a resonant capacitor 92, in addition to a direct current (DC) blocking capacitor 98. Specifically, resonant inductor 82 is coupled between the first node 64 and a fourth node 84, resonant capacitor 92 is coupled between a fifth node 90 and a sixth node 94, and DC blocking capacitor 98 is coupled between a seventh node 96 and the circuit ground node 66. The function of capacitor 98 is to store the DC component of the voltage supplied to output circuit 80 between node 64 and node 66, so that the series combination of resonant inductor 82 and resonant capacitor 92 sees (i.e., between node 64 and node 96) a substantially symmetrical voltage having essentially no DC component, thereby providing a substantially sinusoidal alternating current to lamp 142.

In a preferred embodiment, as shown in FIG. 2, the fourth node 84 and the fifth node 90 are coupled together through a first filament 144 of fluorescent lamp 142, while the sixth node 94 and the seventh node 96 are coupled together through a second filament 146 of fluorescent lamp 142. As long as the first filament 144 and the second filament 146 are intact and properly connected to their respective output wires 130, 132, 134, 136, output circuit 80 will continue will operate since a path exists for alternating (AC) current to flow through resonant inductor 82, first filament 144, resonant capacitor 92, second filament 146, and DC blocking capacitor 98. At the same time, the flow of AC current through filaments 144, 146 provides the filaments with heating current required for rapid-start operation. Output circuit 80 ceases to operate when lamp 142 is removed, or when either one or both of the lamp filaments 144, 146 are not intact or are not connected to their respective output wires 130, 132, 134, 136. Such an output circuit and coupling scheme thus provides the desirable benefit of automatic shutdown of the ballast 200 in the event of lamp removal or an open filament.

An alternative output circuit and coupling scheme that is suitable for applications involving instant-start lamps is shown in FIG. 3. Here, the fourth node 84 and the fifth node 90, as well as the sixth node 94 and the seventh node 96, are connected to each other, and fluorescent lamp 142 is coupled between the fourth node 84 and the seventh node 96.

FIG. 4 shows another output circuit 80 that uses an output transformer 100 to provide electrical isolation between the output wires 130, 132, 134, 136 and AC source 10. The output transformer 100 includes a primary winding 102 that is coupled between the fourth node 84 and the seventh node 96, and at least one secondary winding 104. For applications involving rapid-start lamps, secondary winding 104 may include tap connections 106, 108 for providing a heating voltage across each of the lamp filaments 144, 146. Although the output circuit shown in FIG. 4 shows only a single lamp 142, multiple lamps can be accommodated by including additional secondary windings for filament heating.

Referring back to FIG. 2, the in-rush current limiting function provided by ballast 200 can be understood as follows. When power is initially applied to ballast 200, FET 62 is off and remains off until such time as control circuit 60 begins to operate. Thus, during the period following application of AC power and prior to operation of control circuit 60, ballast 200 has two circuit paths in which in-rush current flows. In the first path, a first current pulse from AC source 10 flows through diode 25, capacitor 24, diode 28, and back to AC source 10. In the second path, a second current pulse flows from AC source 10, through diode 25, clamp inductor primary 46, clamping capacitor 58, diode 50, energy storage capacitor 34, diode 28, and back to AC source 10. The first portion of the in-rush current, i.e., the first pulse, is attributable to the fact that capacitor 24 is initially uncharged when AC power is first applied to the ballast. The second portion of the in-rush current, i.e., the second current pulse, occurs because capacitors 58 and 34 are also initially uncharged. In a number of prior art ballasts, the peak value and the duration of the second current pulse (i.e., that which flows through the energy storage capacitance) is, in the absence of preventative means, on the order of several times that of the first pulse. It is this second portion of the in-rush current that is drastically reduced in ballast 200. Specifically, because clamping capacitor 58 has a capacitance value that is considerably lower than that of energy storage capacitor 34, when AC power is applied to ballast 200, capacitor 58 will charge up at a much faster rate than capacitor 34, and will peak charge very early on in the AC line cycle, thereby terminating the in-rush current pulse before it has had a chance to build up to a high level. In this way, ballast 200 provides for a low peak in-rush current.

Figure 7:
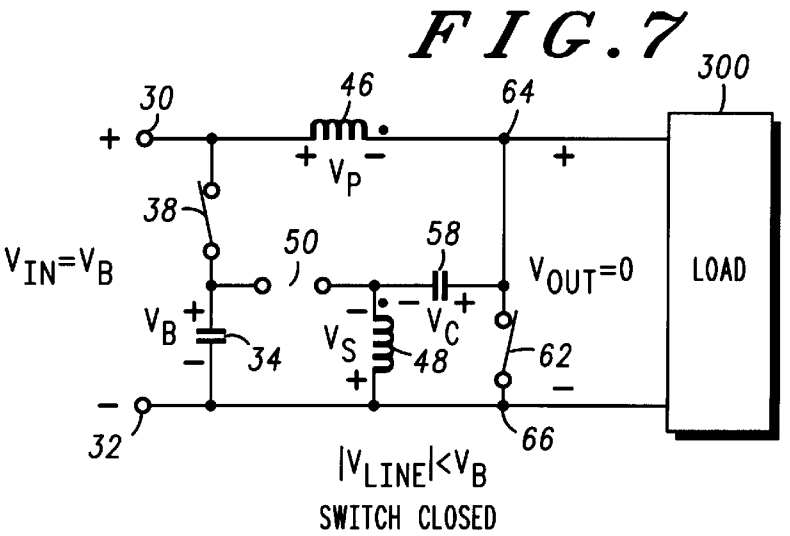
FIGS. 5, 6, 7, and 8 are equivalent circuit diagrams of a portion of the electronic ballast of FIG. 2 for periods in which the electronic switch is open and closed, in accordance with the present invention.
Figure 8:
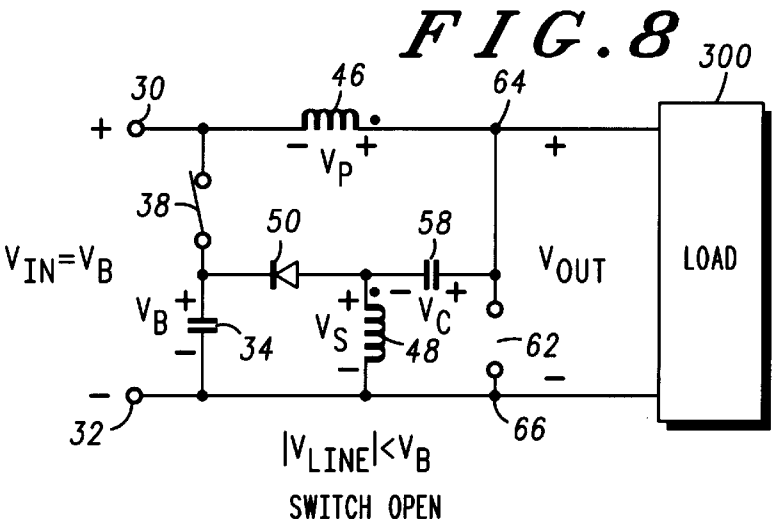
Figure 9:
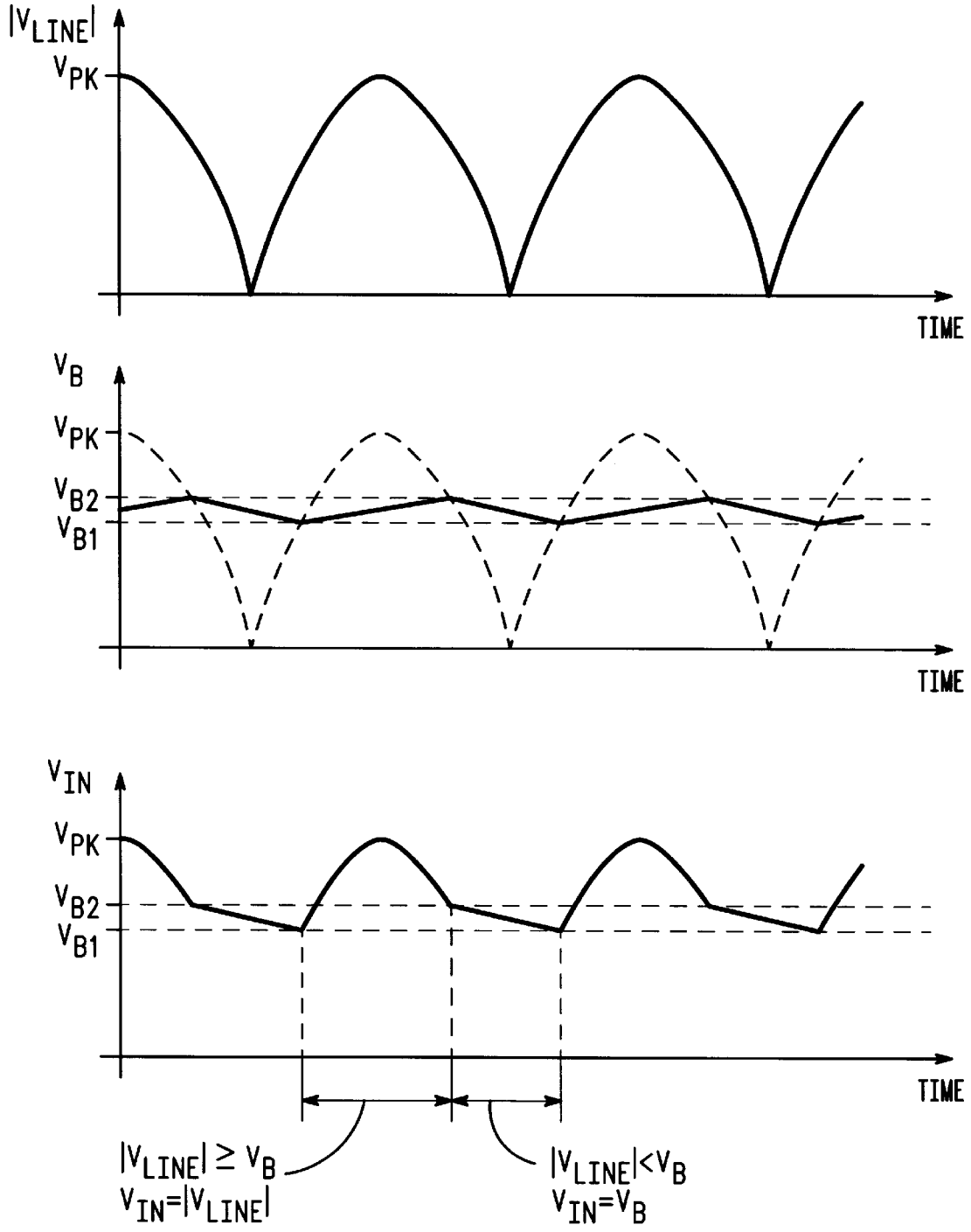
FIG. 9 describes several voltage waveforms applicable to the ballast of FIG. 2, in accordance with the present invention.

Turning now to FIGS. 5–9, the steady-state operation of ballast 200 can be separated into four individual operating modes, corresponding to whether electronic switch 62 is open or closed, and whether the magnitude of the AC line voltage, $|V_{LINE}|$, provided by AC source 10 is greater than or less than the voltage, $V_B$, across energy storage capacitor 34. In particular, FIGS. 5 and 6 describe what occurs when $|V_{LINE}|$ is greater than or equal to $V_B$, while FIGS. 7 and 8 apply when |Vline| is less than $V_B$. As shown in FIG. 9, the input voltage $V_{IN}$ is equal to either $|V_{LINE}|$ or $V_B$, depending upon which is greater. Note that when $|V_{LINE}|$ falls below $V_B$, $V_{IN}=V_B$; consequently, ballast 200 draws no energy from AC source 10 during such periods.

In the following description, it is assumed that the primary 46 and secondary 48 of clamp inductor 44 have an equal number of turns, and that the load 300 includes resonant output circuit 80 and at least one fluorescent lamp 142, as described in FIG. 2. It is further understood that switch 62 is turned on and off at a high frequency rate that is preferably in excess of 20,000 Hertz; this being the case, the rectified line voltage $|V_{LINE}|$, which varies at a low frequency rate (typically, 60 Hertz), can be treated as essentially constant during any single high frequency switching cycle.

Central to understanding the operation of ballast 200 is the fact that, under normal operation, the voltage $V_B$ across energy storage capacitor 34 is inherently less than the peak value, $V_{PK}$, of the AC line voltage provided by AC source 10. Furthermore, in order to provide an acceptable degree of power factor correction, it is desirable that $V_B$ be set at a value that is significantly less than $V_{PK}$. With regard to selecting a suitable value for $V_B$, there is a tradeoff between the competing goals of good power factor correction and an acceptably low lamp current crest factor. Lamp current crest factor, which is defined as the peak to RMS (root mean square) ratio of the lamp current waveform, is generally accepted as an important indication of lamp current quality; specifically, a low crest factor is preferred over a high crest factor. With regard to ballast 200, a lower value of $V_B$ enhances power factor correction (i.e., gives a higher power factor and a lower total harmonic distortion) but degrades the lamp current crest factor (i.e., makes it higher); conversely, a higher value for $V_B$ degrades power factor correction, but lowers the crest factor.

As an illustration, it has been experimentally determined that, for applications in which a standard 120 volt (RMS) AC source ($V_{PK}$=170 volts) is used, it is preferred that ballast 200 be designed so that $V_B$ has an average value of about 110 volts, which provides a good compromise between the competing objectives of power factor correction and low lamp current crest factor.

Figure 5:
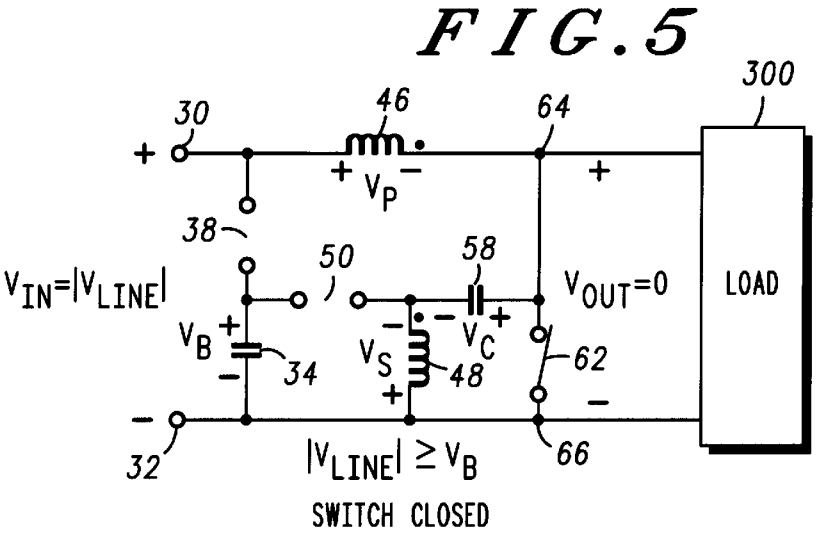

Referring to FIG. 5, which is applicable during those portions of the AC line cycle in which $|V_{LINE}|\geqq V_B$ and when the switch 62 is closed, the input voltage $V_{IN}$ is equal to $|V_{LINE}|$. Because $|V_{LINE}|\geqq V_B$, diode 38 (shown as an open circuit) is reverse biased and energy storage capacitor 34 is prevented from discharging. With the switch 62 closed, the rectified line voltage $|V_{LINE}|$ appears across primary 46 (i.e., $V_P=|V_{LINE}|$), in response to which the current through primary 46 increases in a substantially linear fashion. At the same time, secondary winding 48 also has the voltage $|V_{LINE}|$ across it, but with a negative polarity, and charges up clamp capacitor 58 to the same voltage. As a result of the negative voltage on secondary 48, diode 50 is reverse biased and the voltage, $V_B$, across capacitor 34 remains constant since no current flows into capacitor 34. During this period, all energy supplied to load 300 is provided by AC source 10.

Figure 6:
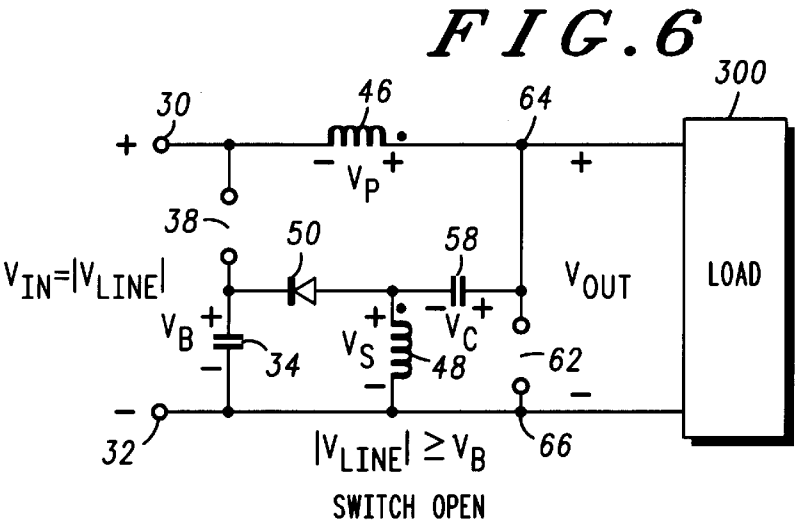

Turning now to FIG. 6, diode 38 is reverse biased and remains reverse biased as long as $|V_{LINE}|\geqq V_B$. Once switch 62 opens, $V_{OUT}$ will tend to rise very rapidly, due to the fact that, instantaneously, there is no path for the primary current to flow. Note that it is assumed that load 300 is such that it does not "sink" or accept the full primary current instantaneously upon opening of switch 62, which is certainly true when load 300 includes resonant inductor 82 (as shown in FIG. 2). Further, the circuit path through clamping capacitor 58 and secondary 48 is, due to the inductance of secondary winding 48, likewise unable to instantaneously accept the primary current. As a consequence of this attempted discontinuity in the primary current, the voltage across the primary 46 will begin to rise at an extremely fast rate. Stated another way, $V_{OUT}$, which is equal to $V_P+|V_{LINE}|$, will begin to rise abruptly. At this point, it might appear that $V_{OUT}$ would simply continue to increase without limit. However, once $V_{OUT}$ attempts to exceed $V_B+|V_{LINE}|$, diode 50 turns on and creates a path for current to flow through clamping capacitor 58, diode 50, and into energy storage capacitor 34. Thus, diode 50, in conjunction with the voltages across capacitors 58 and 34, acts to clamp the voltage at node 64 to the value $V_B+|V_{LINE}|$.

Diode 50 will remain on and charge up capacitor 34 for only a fraction of the time during which switch 62 is off. Specifically, diode 50 will become reverse biased and turn off, thus terminating the charging of energy storage capacitor 34, once the load 300 begins to draw high enough a current to cause $V_{OUT}$ to drop below $|V_{LINE}|+V_B$. Switch 62 then remains open for the duration of the "off" period, during which time current continues to be supplied to load 300 and the current through primary 46 continues to decrease.

When switch 62 is turned on again, the aforementioned events are repeated according to FIGS. 5 and 6, and will continue in this way as long as $|V_{LINE}|$ exceeds $V_B$. Note that, with each switching cycle, $V_B$ is increased in an approximately stair-step fashion. In this way, energy storage capacitor 34 is charged up in preparation for supplying the energy demands of the load 300 when $|V_{LINE}|$ drops below $V_B$.

During those portions of the AC line cycle in which $|V_{LINE}|<V_B$, diode 38 is forward biased and $V_{IN}$ is, neglecting the forward voltage drop across diode 38, equal to $V_B$. When switch 62 is closed, as shown in FIG. 7, the primary voltage $V_P$ becomes equal to $V_B$ and the current through primary 46 increases in an approximately linear fashion. $V_B$ thus begins to decay since capacitor 34 is transferring a portion of its stored energy to primary winding 46. At the same time, no energy is returned to capacitor 34 since diode 50 is reverse biased due to the negative voltage, $V_S=V_B$, that is present across the secondary 48. In addition, the voltage, $V_C$, across clamping capacitor 58 is forced by secondary 48 to be equal to $V_B$.

When switch 62 is subsequently opened, as depicted in FIG. 8, $V_{OUT}$ will rise very rapidly in similar fashion to that described previously, but this time will be clamped to a value equal to 2 $V_B$. This is so because once $V_{OUT}$ reaches and attempts to exceed 2 $V_B$, which is equal to the sum $V_C+V_B$ of the voltages across capacitors 58 and 34, diode 50 becomes forward biased and provides a path for the primary current to flow into energy storage capacitor 34. However, in this case, it should be recognized that the energy contained in the primary 46, which was originally supplied by capacitor 46 during the time in which switch 62 was on, is only partially returned to capacitor 46 after switch 62 is opened. As before, diode 50 will remain on and continue to conduct only until load 300 begins to draw enough of the primary current to cause $V_{OUT}$ to fall below 2 $V_B$. Once $V_{OUT}$ falls below 2 $V_B$, diode 50 ceases to be forward biased and turns off. The net result is that only a fraction of the energy that was taken out of capacitor 34 and transferred to primary 46 while switch 62 was on will be returned to capacitor 34 during the initial portion of the period during which switch 62 is off. $V_B$ will thus begin to recover (increase), but such recovery will be terminated by diode 50 turning off before $V_B$ has had a chance to be restored to its previous value. The remaining energy in primary 46 is not put back into capacitor 34, but is transferred instead to the load 300.

From the foregoing, it can also be understood that an important function of secondary 48 is to provide a reset function with regard to the voltage, $V_C$, across clamping capacitor 58. During those periods in which diode 50 is on, the current which flows through capacitor 58 will cause $V_C$ to increase as well as $V_B$. However, once switch 62 is turned on again, clamping capacitor 58 is effectively connected in parallel with secondary 48, thereby forcing $V_C$ to the voltage across secondary 48 (i.e., either $|V_{LINE}|$ or $V_B$, depending on which is greater). Secondary 48 thus prevents $V_C$ from continuously increasing by resetting the voltage across clamping capacitor 58 each time that switch 62 is turned on.

From FIG. 9, it can be seen that, for those portions of the AC line cycle in which $|V_{LINE}|<V_B$, $V_B$ will steadily decrease from $V_{B2}$ to $V_{B1}$. This fact is intuitively apparent since capacitor 34 supplies all of the energy demands of load 300 during such periods. Conversely, $V_B$ will increase when $|V_{LINE}|$ exceeds $V_B$.

A prototype ballast configured substantially as shown in FIG. 2 was built and tested. The ballast was designed with the average value of the energy storage capacitor voltage, $V_B$, set at approximately 110 volts. A power factor (PF) of 0.914, a total harmonic distortion (THD) of 43%, and a lamp current crest factor (CF) of about 1.7 were measured. Upon application of power to the ballast at the peak of the AC line voltage cycle, an in-rush current with a peak value of approximately 8 amperes and with a very short duration was observed. The disclosed ballast 200 thus provides power factor correction, low in-rush current, and an appropriate quality of high frequency current for efficiently powering fluorescent lamps, yet requires very few components.

A primary advantage of the disclosed ballast 200 is its use of a single electronic switch 62 in conjunction with a clamp inductor 44 such that only a single magnetic component and a single power device is needed in order to provide the functionality of both a power factor correction circuit and an inverter, while at the same time providing a ballast with low in-rush current. In addition, since energy storage capacitor 34 is operated at a voltage that is considerably less than the peak voltage of AC source 10, a smaller and less costly component can be used for capacitor 34. This results in an electronic ballast 200 having a smaller physical size, lower component count, reduced material cost, and greater ease of manufacture than existing approaches.

Although the present invention has been described with reference to a certain preferred embodiment, numerous modifications and variations can be made by those skilled in the art without departing from the novel spirit and scope of this invention.

What is claimed is:

1. An electronic ballast for powering at least one fluorescent lamp, the ballast comprising:

a rectifier circuit having a pair of input terminals and a pair of output terminals, the input terminals being adapted to receive a source of alternating current;

a clamp inductor having a primary winding and a secondary winding, the primary winding being coupled between a first output terminal of the rectifier circuit and a first node, the secondary winding being coupled between a second node and a circuit ground node, the circuit ground node being coupled to a second output terminal of the rectifier circuit;

an electronic switch that is coupled between the first node and the circuit ground node;

a control circuit for driving the power switch;

an energy storage capacitor that is coupled between a third node and the circuit ground node;

a first diode having an anode that is coupled to the third node and a cathode that is coupled to the first output terminal of the rectifier circuit;

a second diode having an anode that is coupled to the second node and a cathode that is coupled to the third node;

a clamping capacitor that is coupled between the first node and the second node; and an output circuit that is coupled between the first node and the circuit ground node, the output circuit having a plurality of output wires that are adapted to being coupled to a lamp load that includes at least one fluorescent lamp.

2. The electronic ballast of claim 1, wherein the rectifier circuit comprises a full-wave diode bridge.

3. The electronic ballast of claim 1, wherein the rectifier circuit includes a high frequency filter capacitor that is coupled across the output terminals of the rectifier circuit.

4. The electronic ballast of claim 1, wherein the electronic switch comprises at least one of a field-effect transistor and a bipolar junction transistor.

5. The electronic ballast of claim 1, wherein the primary and secondary windings of the clamp inductor are oriented in relation to each other such that the presence of a positive voltage across the secondary winding from the second node to the circuit ground node coincides with the presence of a positive voltage across the primary winding from the first node to the first output terminal of the rectifier circuit.

6. The electronic ballast of claim 5, wherein the primary and secondary windings have an approximately equal number of wire turns.

7. The electronic ballast of claim 1, wherein the output circuit comprises a resonant inductor, a resonant capacitor, and a dc blocking capacitor.

8. The electronic ballast of claim 7, wherein the resonant inductor is coupled between the first node and a fourth node, the resonant capacitor is coupled between a fifth node and a sixth node, and a DC blocking capacitor is coupled between a seventh node and the circuit ground node.

9. The electronic ballast of claim 8, wherein the fourth node is connected to the fifth node, the sixth node is connected to the seventh node, and the fourth node and the seventh node are adapted to having at least one fluorescent lamp coupled between them.

10. The electronic ballast of claim 8, wherein the fourth node is adapted to being coupled to the fifth node through a first lamp filament, and the sixth node is adapted to being coupled to the seventh node through a second lamp filament.

11. The electronic ballast of claim 8, further comprising an output transformer having a primary winding and at least one secondary winding, wherein the fourth node is connected to the fifth node, the sixth node is connected to the seventh node, the primary winding of the output transformer is coupled between the fourth node and the seventh node, and at least one secondary winding of the output transformer is adapted to being coupled to at least one fluorescent lamp.

12. An electronic ballast for powering at least one fluorescent lamp, the ballast comprising:

a rectifier circuit having a pair of input terminals and a pair of output terminals, the input terminals being adapted to receive a source of alternating current;

a clamp inductor having a primary winding and a secondary winding, wherein:

the primary and secondary windings having an approximately equal number of wire turns;

the primary winding is coupled between a first output terminal of the rectifier circuit and a first node;

the secondary winding is coupled between a second node and a circuit ground node;

the circuit ground node is coupled to a second output terminal of the rectifier circuit; and the primary and secondary windings of the clamp inductor are oriented in relation to each other such that the presence of a positive voltage across the secondary winding from the second node to the circuit ground node coincides with the presence of a positive voltage across the primary winding from the first node to the first output terminal of the rectifier circuit;

an electronic switch that is coupled between the first node and the circuit ground node;

a control circuit for driving the power switch;

an energy storage capacitor that is coupled between a third node and the circuit ground node;

a first diode having an anode that is coupled to the third node and a cathode that is coupled to the first output terminal of the rectifier circuit;

a second diode having an anode that is coupled to the second node and a cathode that is coupled to the third node; and a clamping capacitor that is coupled between the first node and the second node; and an output circuit that is coupled between the first node and the circuit ground node, the output circuit having a plurality of output wires that are adapted to being coupled to a lamp load that includes at least one fluorescent lamp.

13. The electronic ballast of claim 12, wherein the rectifier circuit comprises a full-wave diode bridge and a high frequency filter capacitor, the high frequency filter capacitor being coupled across the output terminals of the rectifier circuit.

14. The electronic ballast of claim 12, wherein the electronic switch comprises at least one of a field-effect transistor and a bipolar junction transistor.

15. The electronic ballast of claim 12, wherein the output circuit comprises a resonant inductor, a resonant capacitor, and a dc blocking capacitor.

16. The electronic ballast of claim 15, wherein the resonant inductor is coupled between the first node and a fourth node, the resonant capacitor is coupled between a fifth node and a sixth node, and a DC blocking capacitor is coupled between a seventh node and the circuit ground node.

17. The electronic ballast of claim 16, wherein the fourth node is connected to the fifth node, the sixth node is connected to the seventh node, and the fourth node and the seventh node are adapted to having at least one fluorescent lamp coupled between them.

18. The electronic ballast of claim 16, wherein the fourth node is adapted to being coupled to the fifth node through a first lamp filament, and the sixth node is adapted to being coupled to the seventh node through a second lamp filament.

19. The electronic ballast of claim 16, further comprising an output transformer having a primary winding and at least one secondary winding, wherein the fourth node is connected to the fifth node, the sixth node is connected to the seventh node, the primary winding of the output transformer is coupled between the fourth node and the seventh node, and at least one secondary winding of the output transformer is adapted to being coupled to at least one fluorescent lamp.

20. An electronic ballast for powering at least one fluorescent lamp, the ballast comprising:

a rectifier circuit having a pair of input terminals and a pair of output terminals, the input terminals being adapted to receive a source of alternating current;

a clamp inductor having a primary winding and a secondary winding, wherein:

the primary and secondary windings having an approximately equal number of wire turns;

the primary winding is coupled between a first output terminal of the rectifier circuit and a first node;

the secondary winding is coupled between a second node and a circuit ground node;

the circuit ground node is coupled to a second output terminal of the rectifier circuit; and the primary and secondary windings of the clamp inductor are oriented in relation to each other such that the presence of a positive voltage across the secondary winding from the second node to the circuit ground node coincides with the presence of a positive voltage across the primary winding from the first node to the first output terminal of the rectifier circuit;

a field-effect transistor having a gate terminal, a drain terminal, and a source terminal, the drain terminal being coupled to the first node, the source terminal being coupled to the circuit ground node, and the gate terminal being adapted to receive a drive signal for rendering the transistor conductive and non-conductive from the drain terminal to the source terminal;

a control circuit for driving the field-effect transistor;

an energy storage capacitor that is coupled between a third node and the circuit ground node;

a first diode having an anode that is coupled to the third node and a cathode that is coupled to the first output terminal of the rectifier circuit;

a second diode having an anode that is coupled to the second node and a cathode that is coupled to the third node;

a clamping capacitor that is coupled between the first node and the second node; and an output circuit that is coupled between the first node and the circuit ground node, the output circuit having a plurality of output wires that are adapted to being coupled to a lamp load that includes at least one fluorescent lamp, the output circuit comprising:

a resonant inductor that is coupled between the first node and a fourth node;

a resonant capacitor that is coupled between a fifth node and a sixth node; and a DC blocking capacitor that is coupled between a seventh node and the circuit ground node, wherein the fourth node is adapted to being coupled to the fifth node through a first lamp filament and the sixth node is adapted to being coupled to the seventh node through a second lamp filament.

* * * * *